US005669417A

United States Patent [19]

Lian-Jie

[11] Patent Number: 5,669,417

[45] Date of Patent: Sep. 23, 1997

[54] WATER-GUIDE DEVICE IN A TAP

[76] Inventor: Kuo Lian-Jie, No. 69-76, Hsien-Shu Rd.,, Hsien-Chuang City, Taipei Hsien,, Taiwan

[21] Appl. No.: 723,166

[22] Filed: Aug. 30, 1996

[51] Int. Cl.[6] ..... E03C 1/04

[52] U.S. Cl. ..... 137/801; 4/676; 137/606

[58] Field of Search ..... 4/676, 677; 137/606, 137/801; 251/151

[56] References Cited

FOREIGN PATENT DOCUMENTS 2104625 3/1983 United Kingdom ..... 137/801

*Primary Examiner*—Gerald A. Michalsky
*Attorney, Agent, or Firm*—Bacon & Thomas

[57] ABSTRACT

A water-guide device in a tap, which includes an outlet connector with a circular plate, being mounted on the water outlet of a tap; the circular plate of the outlet connector is mounted on a positioning seat by means of a bubble head; the other end of the outlet connector is formed into a cylindrical part to be connected together with a guide pipe; the guide pipe extends through a passage of the body portion of the tap, and to the outer end of a concave seat of the water inlet; the guide pipe is connected with a snap connector having a partitioning ring, and then is connected with a water valve seat. The guide assembly can provide an isolation structure between the water valve seat and the bubble head so as to prevent water stream containing heavy lead from contact with the tap, i.e., to avoid lead being dissolved into water to jeopardize.

3 Claims, 6 Drawing Sheets

WATER-GUIDE DEVICE IN A TAP

BACKGROUND OF THE INVENTION

1. Field of the Invention

This invention relates to a water tap, and particularly to a tap with a water-guide device to prevent water stream from being in contact with the tap cast with a metal so as to avoid lead to be dissolved into water to jeopardize human body.

2. Description of the Prior Art

The conventional tap is usually connected with a pipe made of a red bronze, being welded in place; then, the outer end of the pipe is mounted with a tap. Usually, the welding operation for red bronze is rather complicated, and the outer surface thereof is plated with a lead and zinc alloy; however, as soon as the outer surface thereof is slightly broken, the surface thereof will be oxidized quickly.

Another conventional tap is cast into form with brass, and water inlet thereof is directly screwed to a water valve seat; water will flow through the inner passage thereof to the outlet and the bubble head. Since the tap cast with brass usually contains heavy lead, such heavy lead will be dissolved into the running water; after a long time of drinking by people, the lead in human body will be accumulated gradually to jeopardize one's health eventually; thereof, Texas state in the America has issued a law to the effect that a tap made of brass shall not be in contact with the water therein.

SUMMARY OF THE INVENTION

The prime object of the present invention is to provide a tap with an outlet connector mounted on the water outlet of a tap cast; the circular plate of the outlet connector is mounted to a positioning seat by means of a bubble head; the other end of the outlet connector has a cylindrical part to be connected with a guide pipe, which passes through the body portion of the tap, and extends to the outer end of a concave seat of the water inlet. The guide pipe is connected with a snap connector having a partitioning ring before being connected with a water valve seat. The guide assembly provides an effective isolation structure so as to prevent the water in the tap from contacting the tap containing heavy lead.

Another object of the present invention is to provide a tap, in which the water outlet has a positioning seat, and the outlet connector is made of a stainless steel to be punched into form, and it is fastened to a positioning seat with a circular plate. A washer is mounted between the circular plate and the bubble head so as to isolate water from contacting the body portion of the tap.

Still another object of the present invention is to provide a tap, in which the inside of the outlet connector has a cylindrical part to be connected with the guide pipe, and to be fastened in place with a fixing ring. The guide pipe passes through a passage in the body portion, and extends to the outer end of a concave seat in the water inlet; the guide pipe is connected with the snap connector after the length being adjusted properly, and then it is fastened to the end of the concave seat on the water inlet of the body portion. After the body portion and the water valve seat are connected together, the water will be isolated from the body portion of the tap.

A further object of the present invention is to provide a tap, in which the snap connector mounted in the water inlet is fixedly connected with the guide pipe by means of claws of a fixing ring. An O-ring in the cylindrical hole is used for water-proof. After valve seat, the water will flow directly through the guide pipe to the bubble head, being isolated from the body portion of the tap.

A still further object of the present invention is to provide a tap, in which the snap connector mounted to the concave seat of the water inlet is mounted with a partitioning ring; the inner side and the outer side of the partitioning ring are mounted with washers respectively so as to provide a complete water-proof function among the parts connected together.

DETAILED DESCRIPTION OF THE PREFERRED EMBODIMENT

Figure 1:
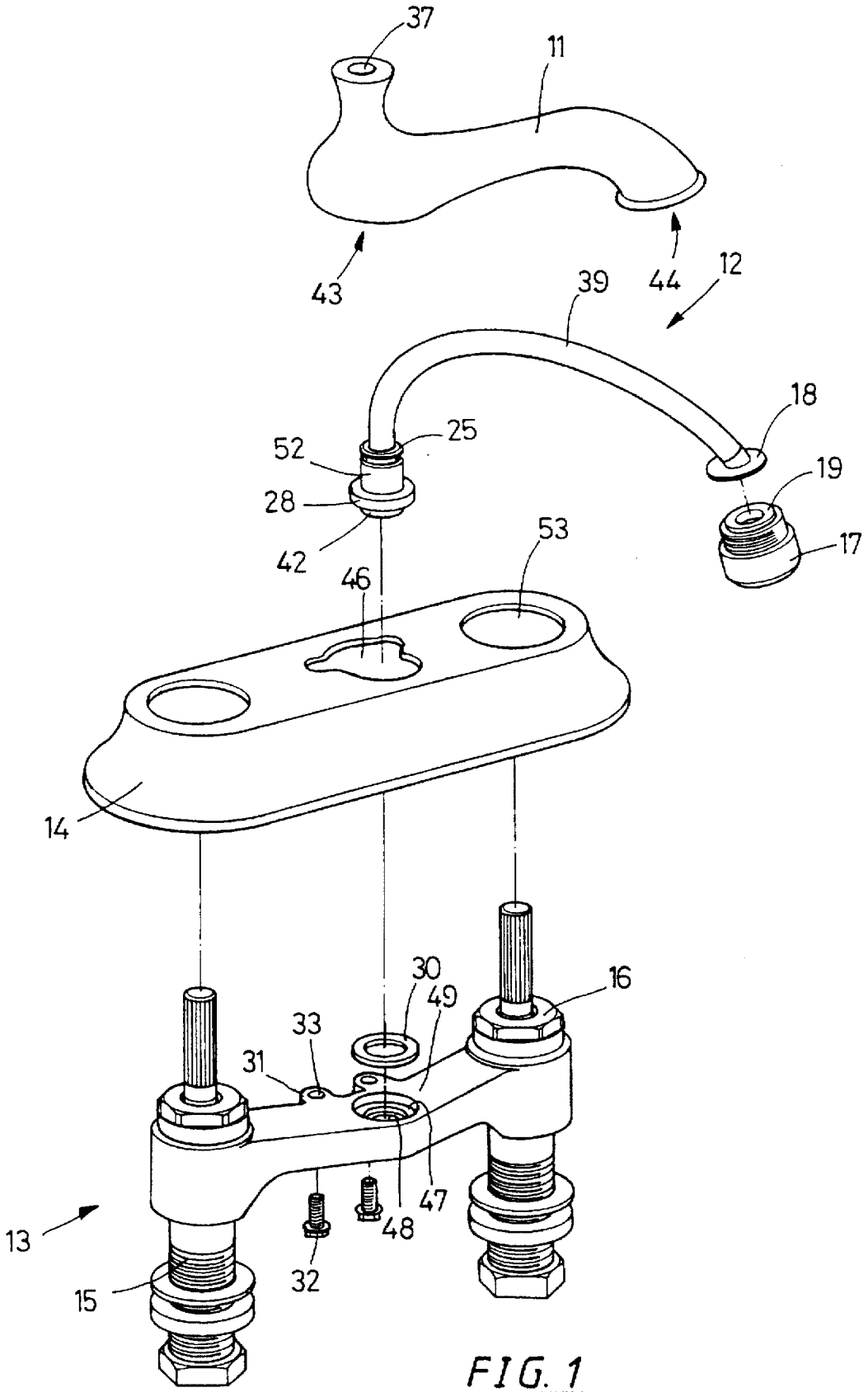
FIG. 1 is a disassembled view of the present invention, showing the relation among the assemblies thereof.

Referring to FIGS. 1 to 4, the tap has a H-shaped water valve seat 13, of which both ends are mounted with two control valves 16 respectively; the two control valves are connected with a hot water pipe and a cold water pipe respectively through a water-supply pipe 15. The center of the water valve seat 13 is provided with a concave seat 47 and a cylindrical hole 48; outside the concave seat 47, there is a plane side 49, which is furnished with a fixing plate 31 with a round holes 33; a plurality of screws 32 to be fitted through the round holes 33 and a center through hole 46 of the fixture 14 so as to have the fixing plate 31 fixedly mounted to a panel outside the water inlet 43 of the body portion 11, and to have the body portion 11, the fixture 14 and the water valve seat 13 fastened together. The control valve 16 is used for supplying a suitable flow of water.

Before the body portion 11 and the water valve seat 13 being assembled together, a guide assembly 12 is mounted between the water inlet 43 and the water outlet 44 of the body portion 11; the guide assembly 12 is used for preventing the wear stream from contacting the body portion 11. The body portion 11 is cast into form by means of brass or a suitable alloy; the water inlet 43 is furnished with a concave seat 24 and a through hole 51 to facilitate a snap connector 52 on one end of the guide pipe 39 of the guide assembly 12 to be fastened in place.

The center part of the water valve seat 13 is provided with a concave seat 47 and a cylindrical hole 48. The upper edge of the concave seat 47 has a plane side 49, of which one side extends into a fixing plate 31 with round holes 33. The fixture 14 is mounted over the water valve seat 13; the two round holes 53 on both ends of the fixture 14 are to be fitted with the shafts of control valves 16 for cold and hot water respectively. The center through hole 46 is opposite to the concave seat 47 of the water valve seat 13 so as to facilitate a partitioning ring 28 and a stud 42 of the snap connector 52 to be mounted on the concave seat 47 of the water valve seat 13.

The water outlet 44 of the body portion 11 cast is furnished with inner threads 22; the center of the body portion 11 has a through hole 50; the positioning seat 23 is used to mount the outlet connector 18, and a washer 19 is mounted between the positioning seat 23 and the bubble head 17. The connector 18 on the water outlet 44 is made of metal to be punched into form; the connector has a circular plate 21 and an oblique cylindrical part 45; the cylindrical part 45 is to be connected with one end of the guide pipe 39, and the outside thereof is mounted with a fixing ring 20. The cylindrical part 45 is in communication with the passage part 38 via the through hole 50. The diameter of the circular plate 21 of the outlet connector 18 is larger than that of the through hole 50, but is smaller than the outer diameter of the positioning seat 23. After passing through the through hole 50, the cylindrical part 45 is in close contact with the flat surface of the positioning seat 23. The outer-edge of the positioning seat 23 is furnished with inner threads 22 to facilitate the bubble head 17 to be connected therein. A washer 19 is mounted between the bubble head 17 and the circular plate 21. After the bubble head 17 is screwed and fixed in place, the washer 19 can isolate the water stream from the body portion 11.

Figure 2:
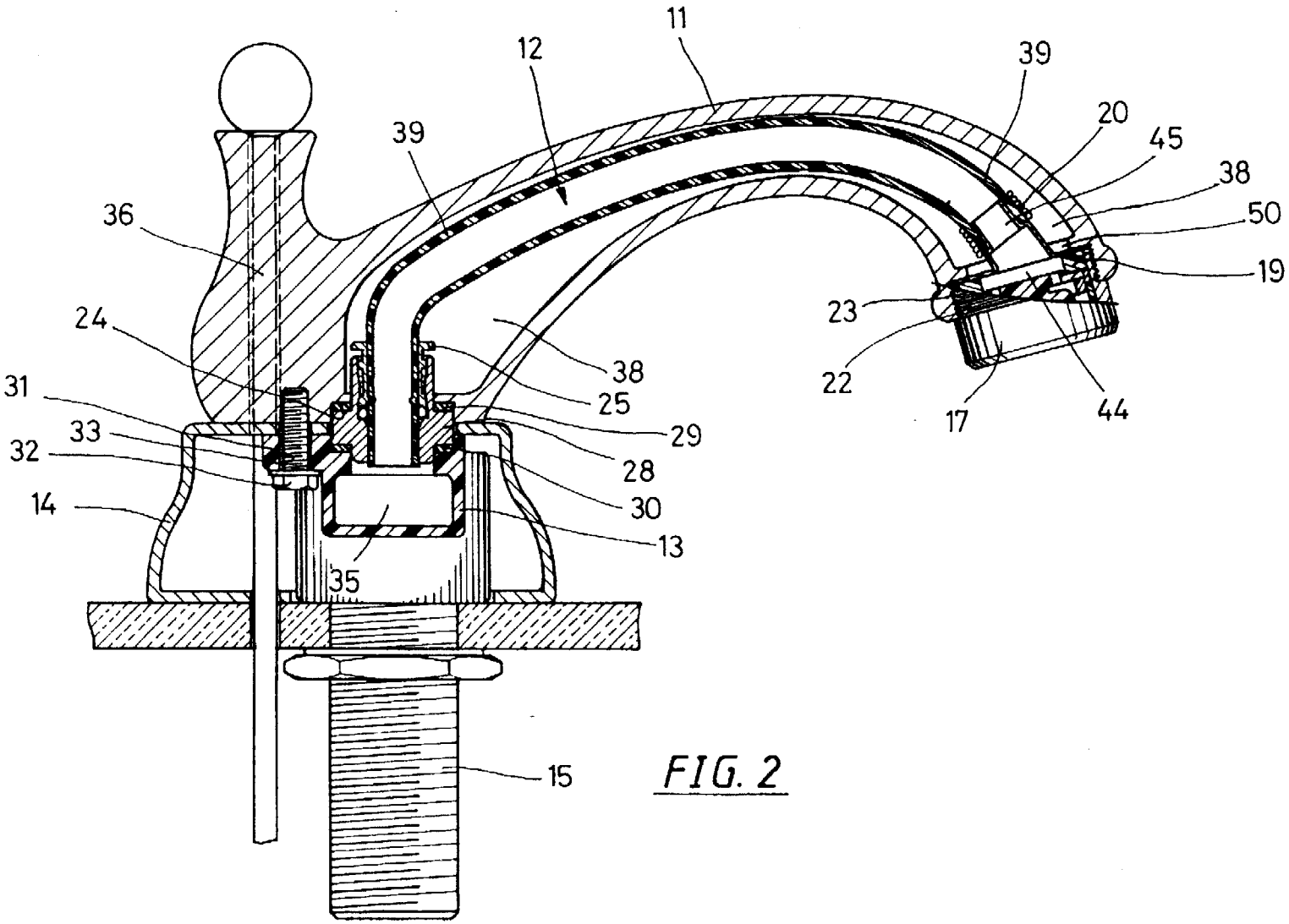
FIG. 2 is a sectional view of the present invention, showing the inner structure thereof.
Figure 4:
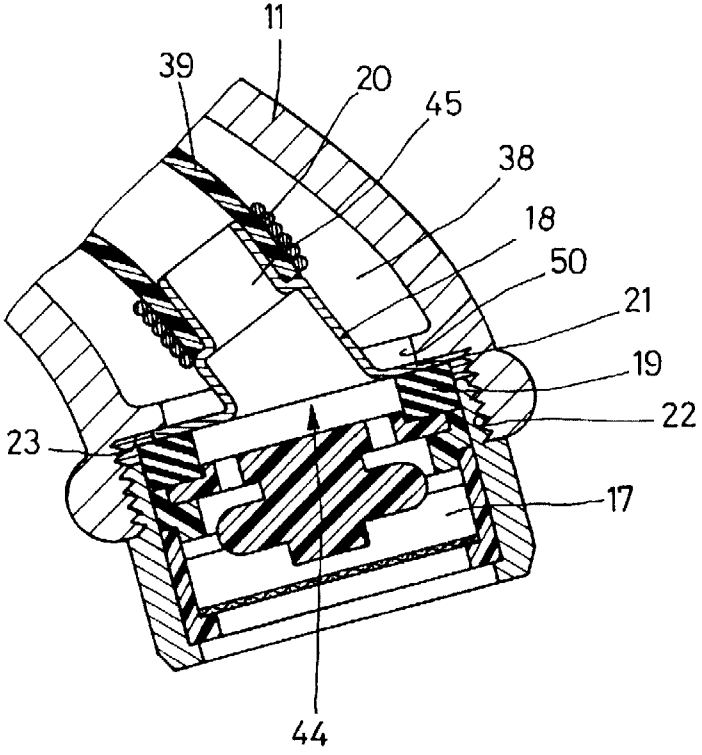
FIG. 4 is a sectional view of the water outlet structure according to the present invention.
Figure 3:
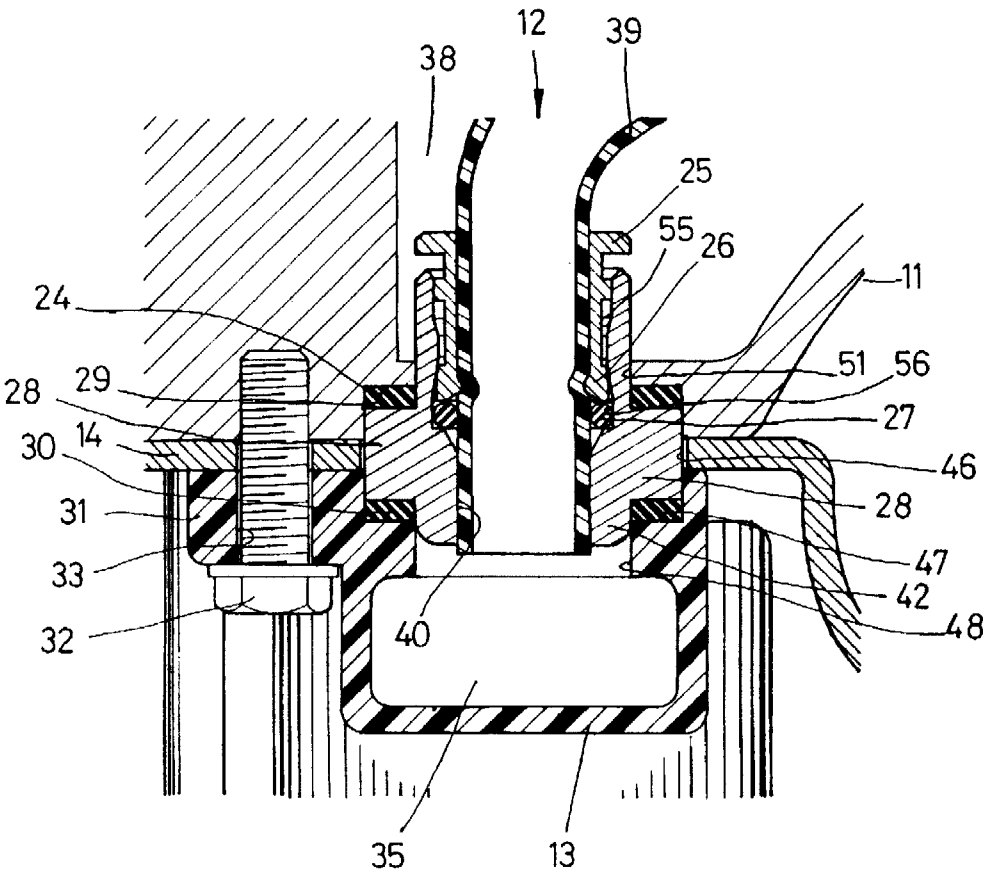
FIG. 3 is a sectional view of the present invention, showing the structure of water inlet thereof.

The water inlet 43 of the body portion 11 has a concave seat 24 for mounting the snap connector 52 therein as shown in FIG. 2; beside the concave seat 24, there is a vertical passage 37 for mounting a water-exhausting pull rod 36 therein. The water inlet 43 of the body portion 11 is furnished with a concave seat 24 and a through hole 51 to facilitate the snap connector 52 to mount in place.

Before the body portion 11 and the water valve seat 13 being assembled together, the guide pipe 39 of the guide assembly 12 passes through the through hole 50 on the water outlet 44 and the passage part 38 of the tap, and then extends to the outside of the concave seat 24 on the water inlet 43; then, a bubble head 17 is mounted to the water outlet 44 by means of the inner threads 22, and then the circular plate 21 of the outlet connector 18 will be fastened to the positioning seat 23. After the guide pipe 39 passing through the concave seat 24, it is connected with the snap connector 52 for adjusting the length of the guide pipe 39; then, the snap connector 52 is fastened to the concave seat 24 of the body portion 11.

The snap connector 52 has a cylindrical hole 40, in which a guide cylindrical surface 58 and an O-ring groove 56 are furnished; the O-ring groove 56 is used for mounting an O-ring 27, while the guide cylindrical surface 55 is used for mounting a fixing ring 25 with a plurality of claws 26. The snap connector 52 is the same as a conventional snap connector to fastened on a pipe end. The fixing ring 25 has a feature of reverse displacement, by which the claws 26 and the guide pipe 39 can be fastened together quickly to prevent the guide pipe 39 from moving unintentionally. After the guide pipe 39 and the snap connector 52 being connected together, the connection thereof can provide a water-proof immediately. The outer surface of the snap connector 52 is a cylindrical part, having a diameter less than that of the through hole 51, and having a partitioning ring 28 with a diameter less than that of the concave seat 24. The height of the partitioning ring 28 is larger than the depth of the concave seat 24. The outer end of the partitioning ring 28 has a stud 42; after the snap connector 52 and the guide pipe being connected together, and the length of the guide pipe 39 being adjusted adequately, the partitioning ring 28 outside the snap connector 52 will be fitted in the concave seat 24; the washer 29 mounted between the partitioning ring 28 and the concave seat 24 can prevent water from entering the passage part 38 of the body portion 11.

The partitioning ring 28 outside the snap connector 52 not only is mounted in the concave seat 24 of the water inlet 43 of the body portion 11, but also extends through the center through hole 36 of the fixture 14, and being mounted in the concave seat 47 of the water valve seat 13. The height of the partitioning ring 28 is designed in accordance with the thickness of the concave seat 24 of the body portion 11, and the center through hole 46 in the fixture 14. The concave seat 47 of the water valve seat 13 is to be fastened in place with screws 32, and then the partitioning ring 28 and he other parts will be set in close connection condition.

The partitioning ring 28 and the stud 42 extended from the snap connector 52 outside the concave seat 24 are connected with the concave seat 47 and the cylindrical hole 48 of the water valve seat 13; the cave seat 47 of the water valve seat 13 has a suitable depth for mounting the washer 30 and connecting with the partitioning ring 28 of the snap connector 52. The cylindrical hole 48 in the center of the concave seat 47 is used for guiding the stud 42 to facilitate the snap connector 52 and the partitioning ring 28 to mount in place. When installing the body portion 11, the water valve seat 13 is mounted with a fixture first; then, the partitioning ring 28 and the stud 42 of the snap connector 52 are put through the center through hole 46 of the fixture 14 so as to connect with the concave seat 47 and the cylindrical hole 48 of the water valve seat 13; by means of the round holes 33 and screws 32 of the fixing plate 31, the body portion 11, the fixture 14 and the water valve seat 13 are assembled together as one piece.

Water can flow through the two control valves 16 and the water passage 35 to enter the concave seat 47, and then flows through the cylindrical hole 40 of the snap connector 52, and the guide pipe 39; finally, flows to the bubble head 17 and the water outlet 44. The water flowing through the guide assembly 12 will not be in contact with the tap cast, and therefore there will be no lead to be dissolved in the water to jeopardize human body.

Figures 5, 6:
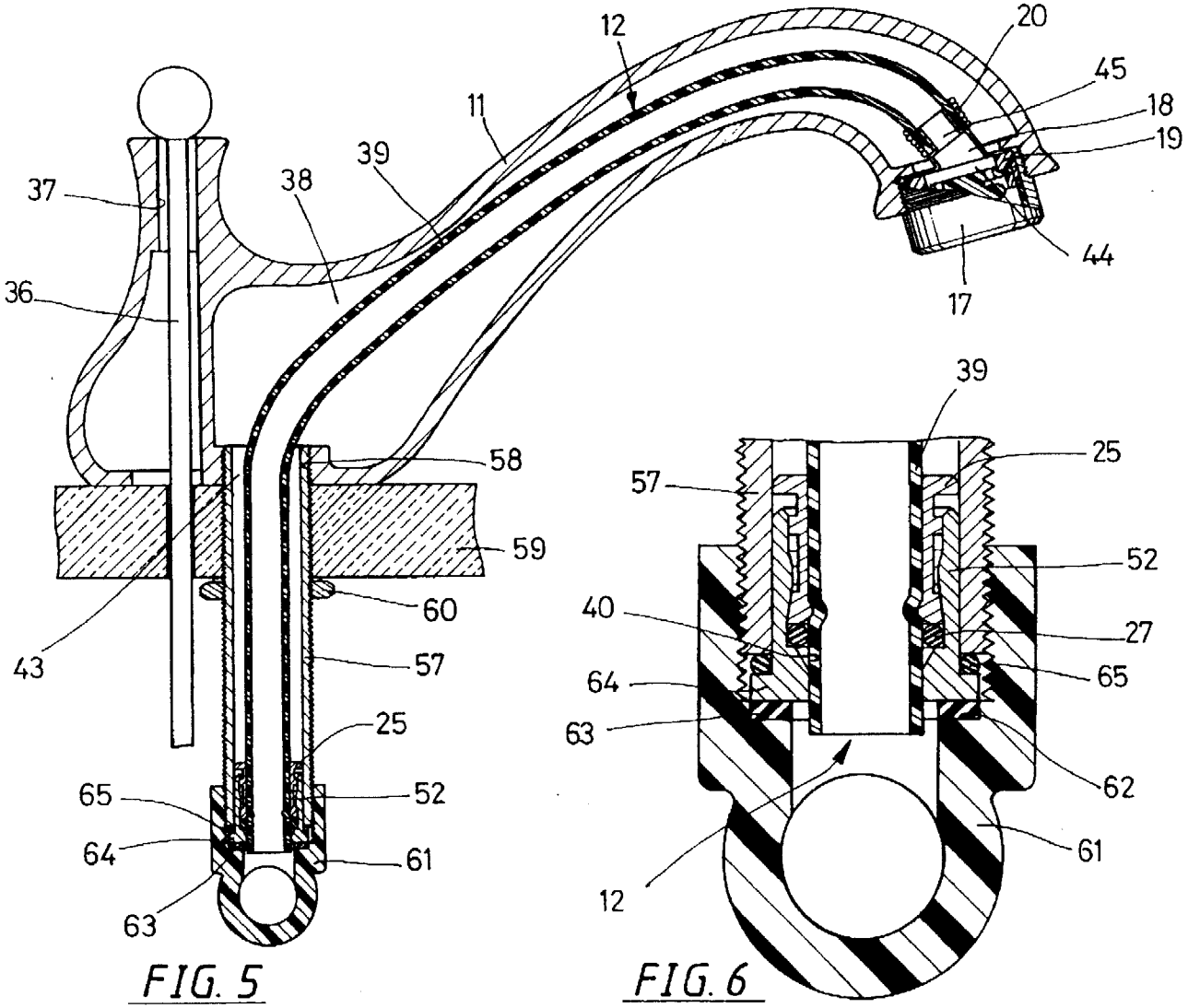
FIG. 5 is a sectional view of the present invention showing an embodiment of the guide assembly mounted with a guide pipe on the water inlet of the tap.
FIG. 6 is a sectional view of the water inlet as shown in FIG. 5.
Figure 7:
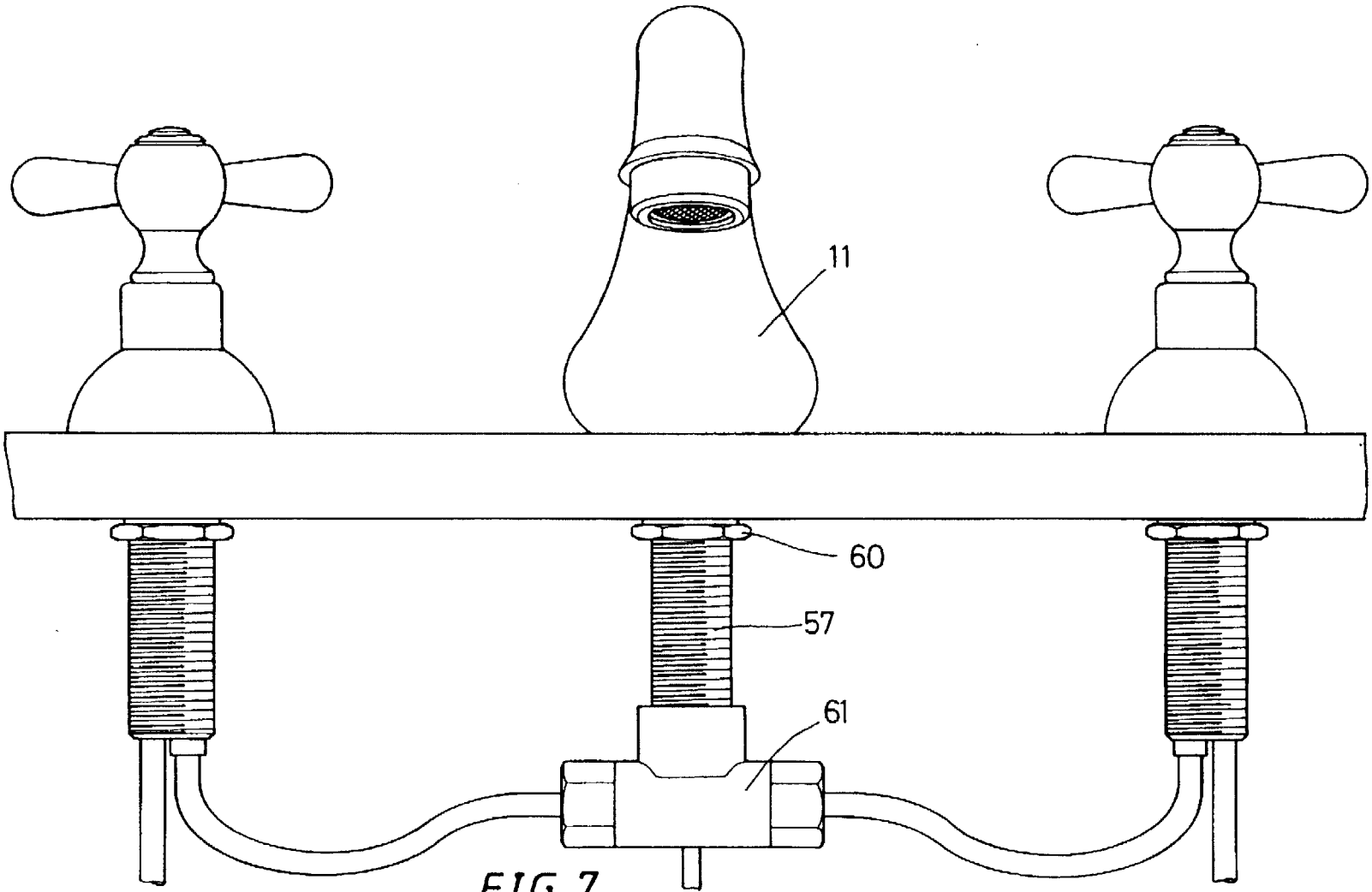
FIG. 7 is a plan view of the present invention, showing the structure of the embodiment as shown in FIG. 5.

Referring to FIGS. 5 to 7, one end of the hollow thread pipe 57 of the body portion 11 is connected with the thread hole 58 of the water inlet 43; the hollow thread pipe 57 has a suitable length so as to pass through a plate member 59 in front of a basin, and then is fastened in place with a nut 60. The lower end of the thread pipe 57 is connected with a T-shaped connector 61 by means of threads. Both ends of the T-shaped connector 61 are connected, via guide pipes, with the control valves 16 respectively so as to control the flow of cold and hot water. The inner bottom of the T-shaped connector 61 has a ring-shaped plane 62 for mounting a washer 63. After the T-shaped connector 61 and the guide pipe 39 being connected tightly, water in the T-shaped connector 61 will directly flow into the guide pipe 39 inside the snap connector 52, and to the water outlet 44 with the bubble head 17.

The structure of the guide assembly 12 is substantially the same as that of the aforesaid embodiment, except the length of the guide pipe 39, the partitioning ring 64 of the snap connector 52 and the contact surface of the hollow thread pipe 57, which have only minor change.

The guide pipe 39 of the guide assembly 12 is inserted from the water outlet 44; the outlet connector 18 is mounted with a bubble head 17, which is screwed to the positioning seat 23. The guide pipe 39 passes through he hollow thread pipe 57, and extends to the end; the guide pipe 39 is connected with a snap connector 52, being fastened in the end thereof. The partition ring 64 is in contact with the end; between the end of the thread pipe 57 and the partition ring 64, and O-ring is mounted. After adjustment being made between the snap connector 52 and the guide pipe 39, the snap connector 52 will be fastened to the end of the thread pipe 57; cut off the additional guide pipe 39 before the thread pipe 57 being screwed together with the T-shaped connector 61. The partition ring 64 of the snap connector 52 is in close contact with the ring-shaped plane 62 of the T-shaped connector 61 by means of washer 63 for water-proof. The control valve 16 is used for controlling the flow of water, i.e., flowing through the T-shaped connector 61, the guide assembly 12 the bubble head 17 and the water outlet.

Figure 8:
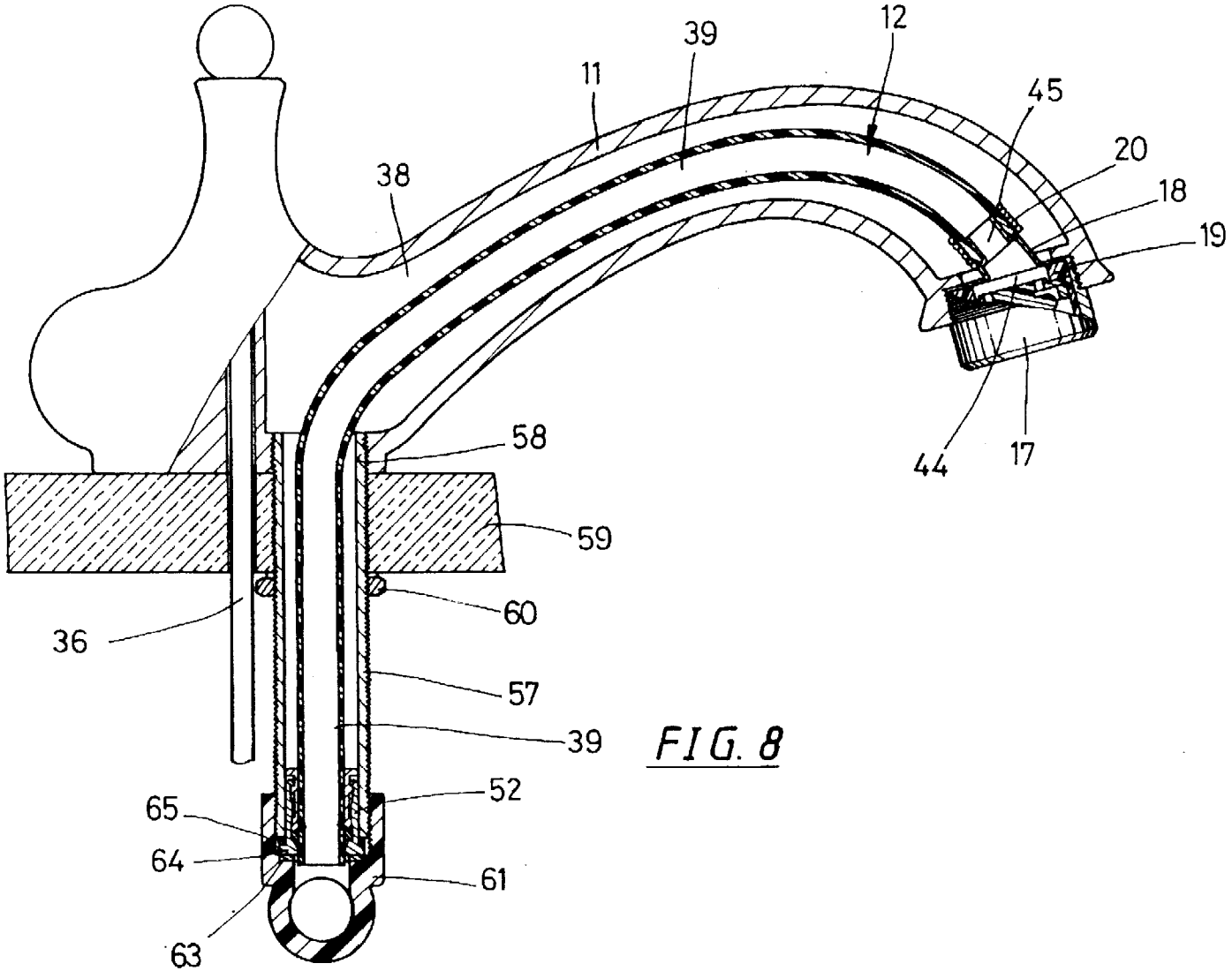
FIG. 8 is a sectional view of the present invention, showing an embodiment-2 of the guide assembly with a guide pipe on the water inlet of the tap.

As shown in FIG. 8, the guide assembly 12 of the body portion 11 is the same as that of FIGS. 5 to 7, except the position of the pull rod 36 of the body portion 11; in FIG. 5, the pull rod 36 is put slightly behind the body portion, the pull rod 36 in FIG. 8 is set in the center position. A thread hole 58 is used for connecting the hollow thread pipe 57; the snap connector 52 of the guide assembly 12 is mounted on the end of the hollow thread pipe 57, and screwed together with the T-shaped connector 61 so as to let water stream not contact with the body portion 11, i.e., no lead being dissolved into the water to jeopardize human body.

The embodiment of the present invention has been described in detail to disclose the features and structure thereof; it is apparent that the present invention has shown the improvement thereof, which is never anticipated and accomplished by others so far; the structure of the present invention is deemed unique.

I claim:

1. A water-guide device in a tap, in which a thread portion for mounting a bubble head on water outlet being furnished, and inside said thread portion, a positioning seat being provided; center of said tap having a through hole; water inlet of said tap having a concave seat and a through hole, and between said water inlet and said water outlet, a passage part being provided to have said water inlet and said water outlet become communicating each other; center of a H-shaped water valve seat having a concave seat and cylindrical hole; plane surface of said H-shaped water valve seat extended beside to form a plurality of fixing plates with round holes for receiving screws so as to have a body portion fastened in place; a guide assembly being mounted between said water inlet and said water outlet in said body portion, and said guide assembly including:

an outlet connector made of a metal piece punched into a form, and said outlet connector having a circular plate to be mounted on a positioning seat; said outlet connector having a cylindrical part extended therein, and said cylindrical part connected with a guide pipe, which being fixed in place with a fixing ring;

a said guide pipe made of a plastic material, being temperature-proof and having no poison, and one end of said guide pipe connected with said cylindrical part of said outlet connector, while other end thereof passing through a passage part of said body portion, and a cylindrical hole of a concave seat of said water inlet, and then said guide pipe connected together with a snap connector and being mounted on a concave seat of said body portion;

a said snap connector, of which center cylindrical hole furnished with a guide cylindrical surface and an O-ring groove for mounting a fixing ring and an O-ring therein respectively; upon said guide pipe passing through said cylindrical hole, said guide pipe being fastened in place by means of claws of said fixing ring so as to prevent said guide pipe from moving; outer portion of said snap connector having a cylindrical part being smaller than a through hole of said water inlet, and having partitioning ring being slightly smaller than diameter of said concave seat of said tap; inner cylindrical part of said partitioning ring passing through a through hole of said water inlet of said body portion, and inner said of said partitioning ring mounted on said concave seat of said water inlet; outer end of said partitioning ring having a stud; said cylindrical part and said stud of said partitioning ring being connected with said concave seat and said cylindrical hole of said water valve seat.

2. A water-guide device in a tap as claimed in claim 1, wherein said snap connector has a said partitioning ring, of which inner side being mounted on said concave seat of said water inlet of said body portion, and outer side of said partitioning ring mounted on said concave seat of said water valve seat, and passed through a center through hole of said fixture; between both said inner and outer sides and said concave seats, washers being mounted respectively; after said fixing plates of said water valve seat being fastened in place with said screws, both said inner and outer sides and said concave seats being in close contact condition.

3. A water-guide device in a tap, in which a water outlet of said tap is provided with threads for mounting a bubble head, and behind said threads, a positioning seat being furnished, and center of said positioning seat having a through hole; a water inlet of said tap mounted with a hollow thread pipe; a guide assembly mounted from one end of said hollow thread pipe to said water outlet of body portion of said tap, and said guide assembly including:

an outlet connector being punched into form, and having a circular plate to be mounted on said positioning seat; said circular plate having a cylindrical part extended inwards, and being mounted with a guide pipe, and connected part of said cylindrical part and said guide pipe being mounted with a fixing ring;

a said guide pipe made of a plastic material, being temperature-proof and having no poison, and one end thereof connected with said cylindrical part of said outlet connector, while other end thereof passing through passage part of said body portion, a hollow thread pipe, and then extended to lower end of said hollow thread pipe; said guide pipe connected with a snap connector, and then both of them being fastened to said lower end of said hollow thread pipe;

a said snap connector, of which center cylindrical hole furnished with a guide cylindrical surface and an O-ring groove for mounting a fixing ring and an O-ring therein respectively; upon said guide pipe passing through said cylindrical hole, said guide pipe being fastened in place by means of claws of said fixing ring so as to prevent said guide pipe from moving; outer portion of said snap connector having a cylindrical part having a diameter less than that of said hollow thread pipe, and having a partition ring being slightly larger than diameter of said hollow thread pipe; an inner cylindrical part of said partition ring mounted in said hollow thread pipe, while inner side of said partition ring mounted in end of said thread pipe; outer ring-shaped plane of said partition ring being a plane, which being in close contact with a washer in inner ring-shaped plane of a T-shaped connector, after said partition ring being connected with said T-shaped connector.

* * * * *